US005379748A

United States Patent [19]

Carlson

[11] Patent Number: 5,379,748

[45] Date of Patent: Jan. 10, 1995

[54] ARCHERY BOW SIGHT

[76] Inventor: Charles W. Carlson, 2811 - 13 Mile Rd., Rockford, Mich. 49341

[21] Appl. No.: 148,179

[22] Filed: Nov. 5, 1993

Related U.S. Application Data

[63] Continuation of Ser. No. 919,612, Jul. 27, 1992, abandoned, which is a continuation of Ser. No. 812,861, Dec. 20, 1991, abandoned, which is a continuation of Ser. No. 669,930, Mar. 15, 1991, abandoned.

[51] Int. Cl.[6] ..... F41G 1/467

[52] U.S. Cl. ..... 124/87; 33/265; 124/90

[58] Field of Search ..... 124/23.1, 24.1, 25.6, 124/35.2, 44.5, 86, 87, 88, 90, 900; 33/265

[56] References Cited

U.S. PATENT DOCUMENTS

| | | | |
|---|---|---|---|
| 3,199,502 | 8/1965 | Stonecipher | 33/265 X |
| 3,410,644 | 11/1968 | McLendon . | |
| 3,703,770 | 11/1972 | Sofield | 33/265 |
| 3,703,771 | 11/1972 | Saunders | 33/265 |
| 3,859,733 | 1/1975 | Chesnick | 33/265 |
| 4,011,853 | 3/1977 | Fletcher | 124/87 |
| 4,116,194 | 9/1978 | Topel | 124/87 |
| 4,220,983 | 9/1980 | Schroeder . | |
| 4,495,705 | 1/1985 | Kowalski et al. | 33/265 |
| 4,625,422 | 12/1986 | Carlson | 33/265 |
| 4,961,264 | 10/1990 | Topel | 33/265 |
| 4,965,938 | 10/1990 | Saunders | 33/265 |
| 5,080,084 | 1/1992 | Kendall et al. | 124/87 |
| 5,148,603 | 9/1992 | Beutler | 33/265 |
| 5,157,839 | 10/1992 | Beutler | 33/265 |

OTHER PUBLICATIONS

"No Serve Peep" Advertisement, Bow and Arrow, Aug. 1986, p. 19.

*Primary Examiner*—Randolph A. Reese
*Assistant Examiner*—John A. Ricci
*Attorney, Agent, or Firm*—Varnum, Riddering, Schmidt & Howlett

[57] ABSTRACT

A bow sight is adapted to be mounted to a bow string and includes a base portion adapted to engage the bow string. A tab is mounted to a top edge of the base portion such that a large, open viewing area is provided above a top edge of the tab. A rear surface of the tab can be of a relatively bright color for providing targeting accuracy in relatively low light intensity environments. Alternatively, the rear surface of the tab can include an illuminating device such as a light emitting diode (LED) for illuminating the tab.

25 Claims, 4 Drawing Sheets

ARCHERY BOW SIGHT

This is a continuation of application Ser. No. 07/919,612 filed Jul. 27, 1992, now abandoned, which was a continuation of application Ser. No. 07/812,861, filed Dec. 20, 1991, now abandoned, which was a continuation of application Ser. No. 07/669,930 filed Mar. 15, 1991, now abandoned.

BACKGROUND OF THE INVENTION

1. Field of the Invention

This invention relates to archery equipment and, more particularly, relates to bow sights mountable on bow strings.

1. Description of Related Art

Archers have long been using sighting apparatus for improving their shooting or targeting accuracy. Various forms of known sighting apparatus include pin sights, telescopic sights, and similar apparatus mounted to the body of the bow. However, these forms of bow-mounted sighting apparatus have hoe been entirely acceptable, in part because of the distance between the sighting apparatus mounted on the bow and the aiming eye of the archer. Certain bow sights seek to overcome this drawback by mounting a sighting eye piece on an arm extending rearwardly from the body of the bow, thereby providing a sighting element nearer the archer's eye. The archer then sights the target through the arm-mounted eye piece, typically in conjunction with further pin sights or telescopic sights mounted on the body of the bow. However, even this type of bow sight has certain additional disadvantages, including increased weight of the bow, and balance and wind resistance problems caused by the arm extending rearwardly from the bow.

Certain of the disadvantages of the arm-mounted bow sight have been avoided by mounting bow sights on the bow string itself. The sights so mounted are utilized either alone or in conjunction with further sighting equipment mounted on the body of the bow. Known bow string-mounted bow sights include the type known as peep sights. In these sights, a piece typically having a sighting hole is mounted between strands of the bow string a fixed distance above a "nocking" point, or fixed point on the bow string. Fletcher, U.S. Pat. No. 4,011,853, issued Mar. 15, 1977, describes one type of archery peep sight. The Fletcher peep sight comprises a disc secured between strands of a bow string. The disc has a frusto-conical surface disposed inwardly from a first side of the disc and a semi-conical recess formed in a second side of the disc. The disc includes a small sight opening which can be used for viewing a target.

One drawback of the use of peep sights mounted to the bow string has been the tendency of the sight to become vertically misaligned relative to the line of sight of the archer as the bow string is drawn. To negate this effect, one can bore the sight opening at an angle relative to the bow string. With the angled boring, the sight opening aligns with the archer's line of sight and the target only when the bow string is fully drawn. An example of this type of angled sight is shown in Chesnick, U.S. Pat. No. 3,859,733, issued Jan. 14, 1975, where a peep sight is formed such that an archer can only view a target when the bow string is fully drawn.

A drawback of these conventional peep sights mounted to the bow string is that the sight opening itself is typically of very small diameter. The small bore of the sight opening is such that a slight movement of the bow or archer during targeting will cause the target to pass out of the archer's line of sight. The small sight opening also causes difficulty by preventing the archer from easily relocating the target. The archer is thereby forced to look away from the bow sight to relocate the target. In addition, a conventional peep sight is not usable in dim light conditions because the small sight opening does not admit sufficient light.

Carlson, U.S. Pat. No. 4,625,422, issued Dec. 2, 1986, solved many of the problems encountered in the prior art, especially those encountered because of small sight openings. The Carlson patent teaches a bow sight comprising a frame portion having a relatively large open central area. The frame portion includes front and rear metallic inserts for providing strength and rigidity to the bow sight. An aiming tab or dot is provided in the open central area for aiming purposes. The relatively large size of the open central area compared to the small size of the aiming dot achieves advantageous results in that a small movement of the bow or archer may cause the target to "drift" from the aiming dot, but often does not cause the target to totally disappear from the open central area. The aiming dot is brightly colored to provide better targeting accuracy, especially in low light intensity environments due to the high visibility of the aiming dot.

There is a need for a bow sight having the advantages of the bow sight taught in the Carlson patent, but which is less expensive to produce, has an open area above the aiming dot which is larger, and which performs even better in low light intensity environments.

SUMMARY OF THE INVENTION

In accordance with the invention, a bow sight is adapted use with a bow having a bow string for providing targeting accuracy. The bow sight is adapted to be mounted to the bow string and comprises a base portion adapted to engage the bow string. In addition, a tab is mounted to a top edge of the base portion, and substantially all of the base portion is disposed below the top edge. In this manner, a large, open viewing area is provided above a top edge of the tab (the concept of an "open" bow sight has been conceived). The tab can include front and rear surfaces, and the rear surface of the tab can be of a relatively bright color for providing targeting accuracy in relatively low light intensity environments.

Also, the bow sight can include active means mounted to the rear surface of the tab for illuminating the tab. The active means can include a light emitting diode (LED). The active means can be mounted to the tab so as to project illumination at an angle of approximately 45° relative to a vertical axis when bow string is in an uncocked or undrawn position. The rear surface of the tab preferably comprises an upper wall and a lower wall which intersect at an angle of approximately 90°. The active means can be mounted substantially flush against the upper wall so as to project illumination at an angle of approximately 90° relative to a vertical axis when the bow string is substantially fully drawn.

The bow string can include separable strands. The bow sight can further include engaging means associated with the base portion for engaging the strands. The engaging means can include a pair of arcuate channels disposed on opposing sides of the base portion.

The bow sight can also include means associated with the base portion for constraining the bow sight against vertical movement relative to the bow string, when the base portion engages the bow string. The base portion can include front and rear surfaces, and the means for constraining can include a plurality of fingers extending outwardly from the front and rear surfaces. Further, the base portion can include a bottom edge, and the means for constraining can include a substantially cylindrically-shaped foot mounted to the bottom edge of the base portion. The foot is mounted so that approximately one hair of a length of the foot extends forwardly of the bottom edge, and approximately one half of the length of the foot extends rearwardly of the bottom edge. The means for constraining can be adapted to engage a serving string.

The base portion can include a substantially heart-shaped top portion, and a tapered bottom portion mounted to and positioned below the heart-shaped top portion. The heart-shaped top portion can include substantially identical front and rear surfaces, and a pair of opposing sides. Each of the sides can include an arcuate channel disposed therein and adapted to engage separable strands of the bow string. Each of the arcuate channels can be of a semicylindrical configuration.

The tapered bottom portion can include front and rear surfaces and a pair of opposing sides. Each of the front and rear surfaces and sides can converge inwardly from top to bottom so as to form a bottom edge of the bow sight. The bow sight can include a substantially cylindrically-shaped foot mounted to the bottom edge and positioned so that a central horizontal axis of the foot is substantially perpendicular to the front and rear surfaces of the heart-shaped top portion. A plurality of fingers can be located on a lower half of the tapered bottom portion, and extend outwardly from the front and rear surfaces of the bottom portion. In this manner, each of the fingers includes a central horizontal axis substantially parallel with a central horizontal axis of the cylindrically-shaped foot, and the foot and the fingers cooperate to secure the bow sight to the bow string.

BRIEF DESCRIPTION OF THE DRAWINGS

The invention will now be described with reference to the drawings in which.

DESCRIPTION OF THE PREFERRED EMBODIMENTS

Figure 6:
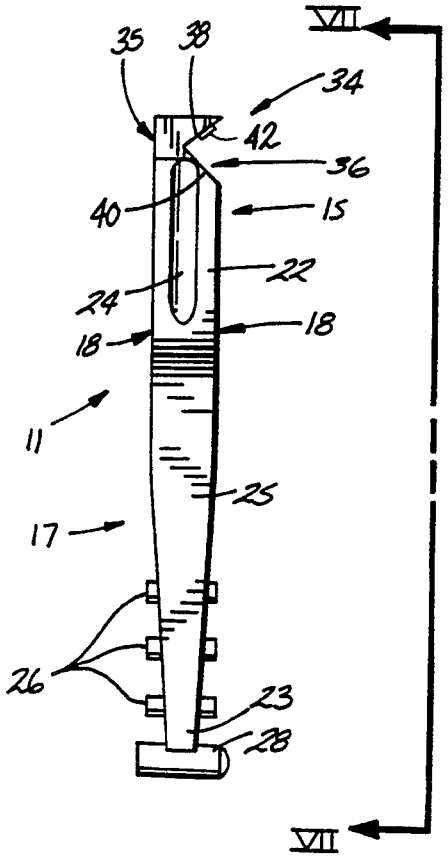
FIG. 6 is a side view of a second embodiment of the bow sight shown in FIG. 1.
Figure 7:
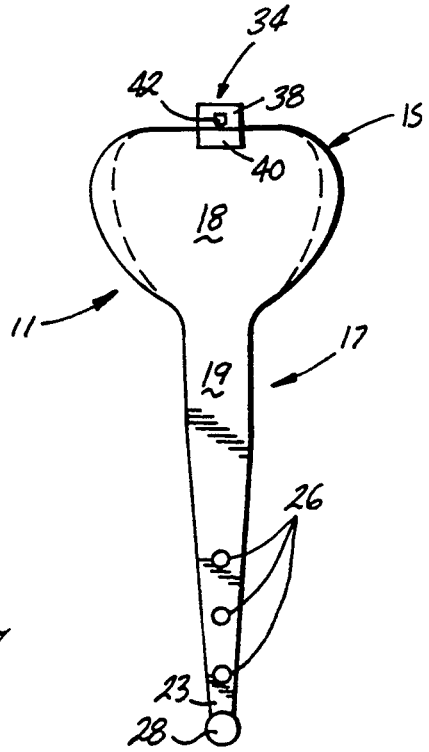
FIG. 7 is a rear view of the bow sight shown in FIG. 6, taken along line 7—7 of FIG. 6.

The principles of the invention are disclosed, by way of example, in bow sights 10, 11. The bow sight 10 is illustrated in FIGS. 1–5, while the bow sight 11 is illustrated in FIGS. 6 and 7. The bow sights 10, 11 enjoy several advantages over prior art bow sights. For example, the bow sights 10, 11 provide a relatively large, open viewing area useful for an archer in locating a target. No portion of the bow sight 10 or the bow sight 11 protrudes into or extends above the viewing area. Thus, the bow sights 10, 11 can be referred to as "open" bow sights and constitute a significant advance over prior art. bow sights which are typically of the peep sight variety. Further, the bow sights 10, 11 are inexpensively produced and advantageously adapted for use in relatively low light intensity environments.

Figure 1:
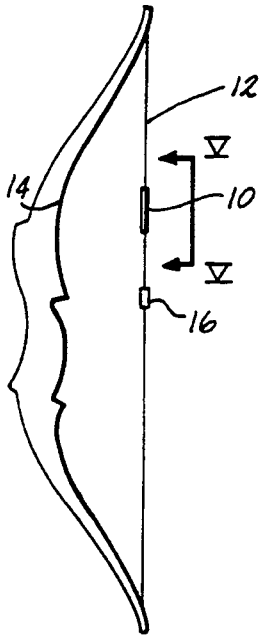
FIG. 1 is an elevation view of a bow, showing a bow sight according to the invention mounted on a bow string.

Referring specifically to FIG. 1, a bow 1 is shown having a conventional main body 14 and a bow string 12 interconnected to the body 14 adjacent upper and lower ends thereof. A bow sight 10 is mounted on the bow string 12. A particular arrangement for mounting the bow sight 10 to the bow string 12 will be described with respect to FIG. 5 in subsequent paragraphs herein. The bow sight 10 can be utilized with virtually any type of conventional bow and, accordingly, the bow 1 depicted in FIG. 1 does not form the basis of any patentable features of the invention. It should be emphasized, however, that the bow sight 10 in accordance with the invention is suitable for use not only with simple bows, but also with compound bows utilizing the commonly known elaborate pulley and cable systems for purposes of achieving optimum drawstring tension.

The bow string 12 can include a conventional nocking point 16, i.e., a fixed point on the bow string where a rear end of an arrow shaft (not shown) is typically engaged. The bow sight 10 can be mounted on the bow string 12 a fixed distance above the nocking point 16.

Figure 2:
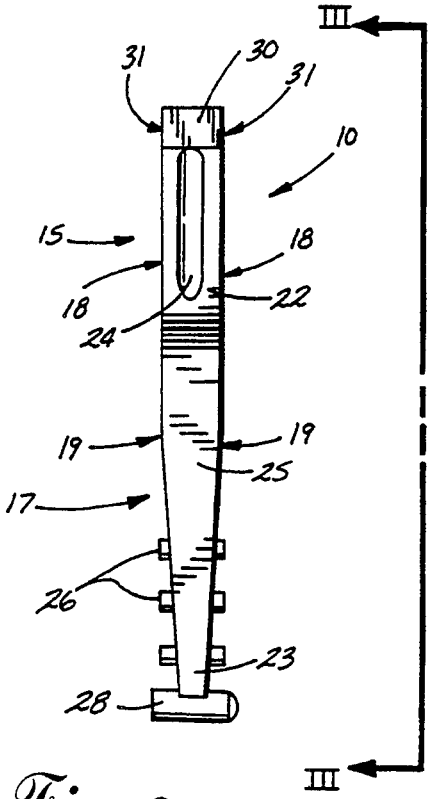
FIG. 2 is a side view of the bow sight shown in FIG. 1.
Figure 3:
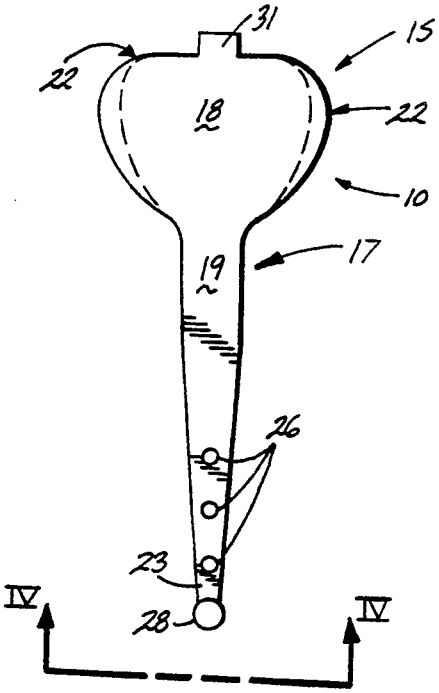
FIG. 3 is a rear view of the bow sight shown in FIG. 1, taken along line 3—3 of FIG. 2.

The bow sight 10 will now be described in greater detail with respect to FIGS. 2–5. Referring first to FIGS. 2 and 3, the bow sight 10 includes a heart-shaped top portion 15 and a tapered bottom portion 17 mounted to and positioned below the heart-shaped top portion 15. Preferably, the heart-shaped top portion 15 and the tapered bottom portion 17 are integrally mounted.

Figure 4:
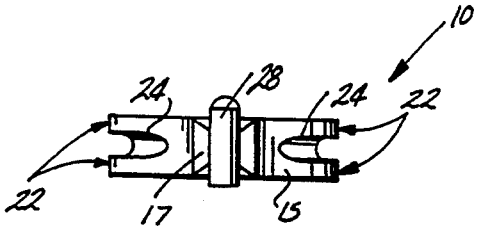
FIG. 4 is an underside view of the bow sight shown in FIG. 1, taken along line 4—4 of FIG. 3.

The heart-shaped top portion 15 comprises identical front and rear surfaces 18 (only the rear surface 18 is shown in FIG. 3) and sides 22 (only one side 22 is shown in FIG. 2). Referring to FIGS. 2 and 4, each side 22 of the heart-shaped top portion 15 has an arcuate channel 24 disposed therein which is adapted to engage strands 13 (FIG. 5) of the bow string 12. The channels 24 preferably have a semicylindrical shape, but could alternatively have a V-shape or a U-shape. Also, the channels 24 should be of sufficient depth and width so that the strands 13 of the bow string 12 can be snugly engaged within the channels 24, once the bow sight 10 is mounted on the bow string 12.

As further shown in FIGS. 2 and 3, the tapered bottom portion 17 has front and rear surfaces 19 (only the rear surface 19 is shown in FIG. 3) and sides 25 (only one side 25 is shown in FIG. 2). The front and rear surfaces 19 and sides 25 of the tapered bottom portion 17 converge inwardly toward each other from the upper area to the lower area of bottom portion 17, so as to form a bottom edge 23 of the bow sight 10.

Referring specifically to FIG. 2, a cylindrically-shaped shaped foot 28 is integrally mounted or otherwise connected to the bottom edge 23 and is positioned such that its central horizontal axis is substantially perpendicular to the front and rear surfaces 18 of the heart-shaped top portion 15. In addition, the cylindrically-shaped foot 28 is mounted such that about half of its length extends forwardly of the bottom edge 23 and about half of its length extends rearwardly of the bottom edge 23.

With further reference to FIG. 2, approximately located in a lower half of the tapered bottom portion 17 are three fingers 26 extending outwardly from both the front surface 19 and the rear surface 19. The fingers 26 have central horizontal axes which are substantially parallel with the central horizontal axis of the cylindrically-shaped foot 28.

Figure 8:
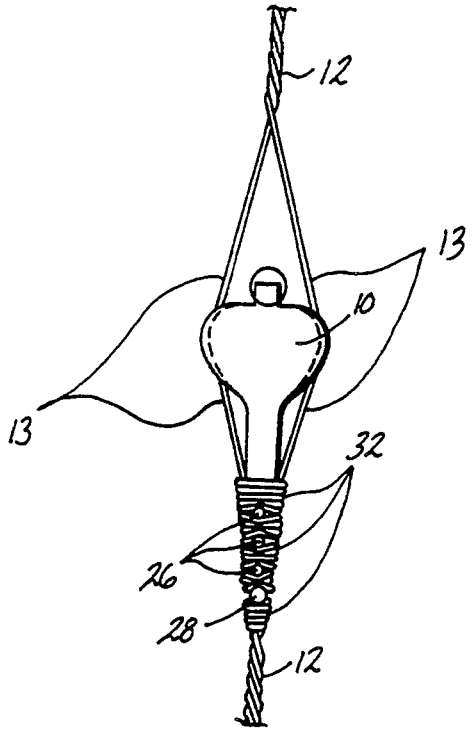
FIG. 8 is similar to FIG. 5 but shows the rear surface of the tab of the bow sight as having a circular shape.
Figure 9:
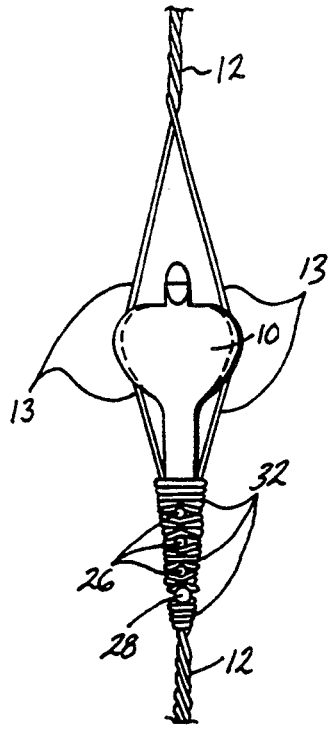
FIG. 9 is similar to FIG. 8 but shows the rear surface of the tab as having an oval shape.
Figure 10:
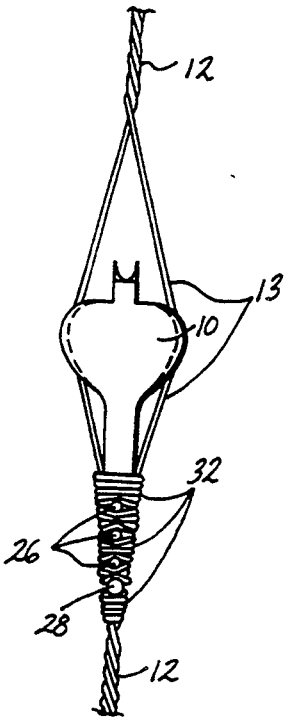
FIG. 10 is similar to FIG. 8 but shows the rear surface of the tab as having a U-shape.
Figure 11:
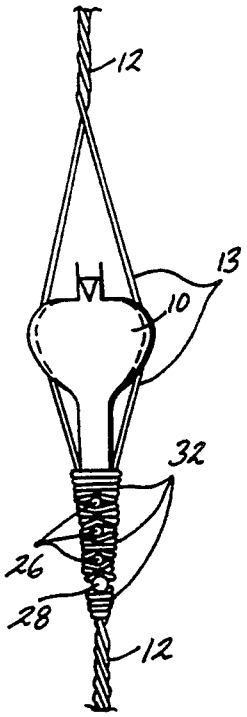
FIG. 11 is similar to FIG. 8 but shows the rear surface of the tab as having a V-shape.

Referring to FIGS. 2 and 3, mounted to the top of the heart-shaped top portion 15 is a tab 30 having identical front and rear surfaces 31 (only the rear surface 31 is shown in FIG. 3). The rear surface 31 of the tab 30 preferably has a rectangular shape (FIG. 5), but can alternatively have other shapes including, but not limited to, a circular shape (FIG. 8), an oval shape (FIG. 9), a U-shape(FIG. 10), or a V-shape (FIG. 11). If desired, the first surface 31 of the tab 30 can also be provided with any of these shapes.

Preferably, the tab 30 and the heart-shaped top portion 15 are integrally mounted. The rear surface 31 of the tab 30 can be decorated orange or another very bright color and, if desired, the front surface 31 can also be decorated with a very bright color. The decoration of the tab 30 can be accomplished by using any conventional decorating process including, but not limited to, painting, hot foil stamping, silkscreening, heat transfer, appliques, and two-color injection molding.

The tab 30 serves as an aiming dot for an archer. That is, the tab 30 provides a point which the archer can align with a target. The brightly colored rear surface 31 of the tab 30 assists the archer in aligning the tab 30 with the target. Alternatively, the archer can align the tab 30 with a conventional front bow sight (not shown) located on the main body 14 of the bow 1. The brightly colored rear surface 31 of the tab 30 is especially useful in relatively low light intensity environments.

Figure 5:
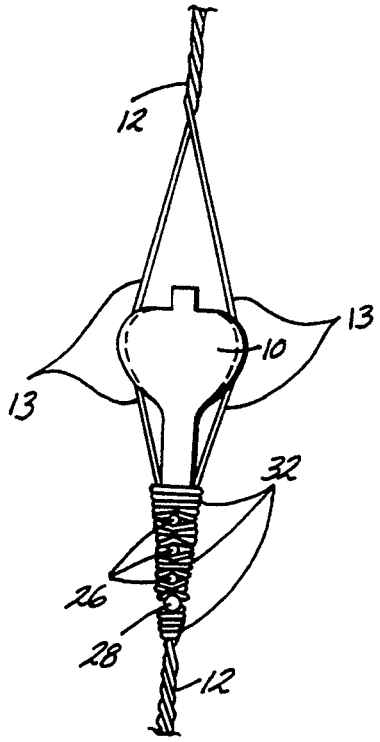
FIG. 5 is a rear view of the bow sight shown in FIG. 1, illustrating an attachment of the bow sight to the bow string, and taken along line 5—5 of FIG. 1.

Referring primarily to FIG. 5, the bow sight 10 is mounted on the bow string 12 by separating strands 13 of the bow string 12 and inserting the bow sight 10 between the strands 13. The strands 13 are then released and thereby engage the channels 24 (FIGS. 2 and 4). Upward or downward movement of the bow sight 10 relative to the bow string 12 can be prevented by wrapping a conventional serving string 32 around the strands 13 of the bow string 12 in the area of the fingers 26 and the cylindrically-shaped foot 28. The serving string 32 should be wrapped tightly around the strands 13 of the bow string 12 so that the serving string 32 and the underlying strands 13 firmly bear against the sides 25 (FIG. 2) of the tapered bottom portion 17. Thus, the bow sight 10 is constrained against vertical movement relative to the bow string 12 by the fingers 26 and the cylindrically-shaped foot 28.

Referring to FIGS. 6 and 7, in a second embodiment of the invention, a bow sight 11 is shown which is substantially identical to the previously described bow sight 10. However, bow sight 11 includes a tab 34 having a front surface 35 and a rear surface 36. The rear surface 36 of the tab 34 has a light-emitting diode (LED) 42 disposed therein. A bow-mounted LED is taught in Schroeder, U.S. Pat. No. 4,220,983, issued Sep. 2, 1980. The LED 42 can be disposed in the tab 34 and powered by using a mounting arrangement similar to that disclosed in the Schroeder patent. That is, with reference to FIG. 1, a battery (not shown) for powering the LED 42 (FIGS. 6 and 7) can be mounted on the bow 1. Lead wires (not shown) can connect the battery to the LED 42 by mounting the lead wires so that they extend from the battery along the bow body 14, and along the bow string 12 to the LED 42 of the bow sight 11 (bow sight 10 is shown in FIG. 1).

The LED 42 should be disposed on the rear surface 36 of the tab 34 so that light from the LED 42 assists the archer in aligning the tab 34 with the target or the front bow sight. The rear surface 36 of the tab 34 can be provided with any of a number of different shapes including, but not limited to, an L-shape, shape, a V-shape or a U-shape. The rear surface 36 can also be formed as a planar surface, although the angles of illumination discussed below would change. The rear surface 36 preferably comprises an upper wall 38 and a lower wall 40 which intersect to form an approximately 90° angle. The LED 42 is preferably mounted flush against the upper wall 38 so that it shines downwardly at a 45° angle with respect to the vertical when the bow string is in an uncocked or undrawn position. However, when the bow string is substantially fully cocked or drawn, the LED 42 shines rearwardly at a 90° angle with respect to the vertical In general, other types of "illuminating" devices can also be used in accordance with the invention. The LED 42 provides an "active" means for illumination.

Referring again to FIG. 1, in use, the bow sight 10 or the bow sight 11 is mounted on the bow string 12 a desired, fixed distance above the nocking point 16. In viewing the target, the archer's line of sight passes over the tab 30 or the tab 34, providing a point which the archer can align with the target. Because there is a relatively large open area above the tab 30 or the tab 34, movements of the archer or bow during aiming, while possibly causing the target to "drift" from the tab 30 or the tab 34, will not cause the target to disappear from the archer's line of sight. Thus, the archer may easily realign the target with the tab 30 or the tab 34 without looking away from the bow sight 10 or the bow sight 11.

With respect to the bow sight 10, the bright color of the tab 30 increases sighting and targeting accuracy, especially in relatively low light intensity environments. In operation, the brightly decorated rear surface 31 of the tab 30 should face the archer so that the tab 30 can easily be seen by the archer.

With respect to the bow sight 11, the LED 42 provides an even greater sighting and targeting accuracy than the bow sight 10, especially in relatively low light intensity environments. In operation, the rear surface 36 of the tab 34 should face the archer, so that the shining light of the LED 42 illuminates the tab 34. Because the tab 34 is illuminated, it can easily be seen by the archer.

Use of the bow sight 10 or the bow sight 11 eliminates the necessity of precise boring or other formation of a sight opening at an angle with respect to the bow string. That is, the bow sight is operable even though the bow sight may become somewhat vertically misaligned with respect to the target as the bow string is drawn.

Each bow sight 10, 11 can be constructed in an economical, efficient manner by injection molding the entire bow sight as a unitary whole. Preferably, the entire bow sight is made of plastic. Thus, the bow sights 10, 11 can be simply and quickly formed by obtaining suitable molds for each respective bow sight 10, 11. The molds can be used to injection mold the heart-shaped top portion 15, the tapered bottom portion 17, the fingers 26, the cylindrically-shaped foot 28, and the tab 30 (of the bow sight 10) or the tab 34 (of the bow sight 11) in a one-step process. With respect to the bow sight 10, the rear surface 31 of the tab 30 can then be decorated a bright color. With respect to the bow sight 11, the LED 42 can be disposed in the rear surface 36 of the tab 34 as previously described herein.

The principles of the invention are not limited to the specific bow sights 10, 11 described herein. It will be apparent to those skilled in the art that modifications and variations of the above-described illustrative embodiments of the invention may be effected without departing from the spirit and scope of the novel concepts of the invention. For example, the bow sight 10 can be modified so that the rear surface 31 of the tab 30 is decorated orange and the front surface 31 has an LED disposed therein. This would allow the archer to mount and position the bow sight on the bow string to have either the brightly decorated surface facing the archer or the surface having the LED disposed therein facing the archer.

The embodiments of the invention in which an exclusive property or privilege is claimed are defined as follows:

1. A bow sight adapted for use with a bow having a bow string comprising separable strands, for providing targeting accuracy, said bow sight adapted to be mounted to said bow string and comprising:

a base portion adapted to be mounted to said bow string, said base portion including a top portion positioned between and engaged by said separable strands of said bow string;

said top portion having a top edge wherein substantially all of said base portion is disposed below said top edge, so that a large, open viewing area is provided above said top portion top edge and between said separable strands of said bow string when said top portion is mounted between and engaged by said separable strands of said bow string;

said top portion having a width relative to remaining portions of said base portion below said top portion so that the maximum spread of said separable strands along the length of said bow sight occurs along said top portion;

a narrow sight pin extending upwardly from said top edge, said sight pin having a height and a width, the width being substantially less than the width of the top portion top edge over substantially the height of the sight pin, and being entirely disposed in said viewing area when said top portion is mounted between and engaged by said separable strands of said bow string; and said bow sight is configured so that a user's line of sight toward a target is substantially unrestricted through said large, open viewing area when said bow string is substantially fully cocked or drawn by said user.

2. A bow sight in accordance with claim 1 characterized in that said sight pin comprises front and rear surfaces, and said rear surface of said sight pin is of a relatively bright color for providing targeting accuracy in relatively low light intensity environments.

3. A bow sight in accordance with claim 1 characterized in that said bow sight further comprises engaging means associated with said top portion for engaging said separable strands.

4. A bow sight in accordance with claim 3 characterized in that said engaging means comprises a pair of arcuate channels disposed on opposing sides of said top portion.

5. A bow sight in accordance with claim 1 characterized in that said bow sight further comprises means associated with said base portion for constraining said bow sight against vertical movement relative to said bow string, when said base portion engages said bow string.

6. A bow sight in accordance with claim 5 characterized in that said base portion comprises front and rear surfaces, and said means for constraining comprises a plurality of fingers extending outwardly from said front and rear surfaces.

7. A bow sight in accordance with claim 5 characterized in that said base portion comprises a bottom edge, and said means for constraining comprises a substantially cylindrically-shaped foot mounted to said bottom edge of said base portion, so that approximately one half of a length of said foot extends forwardly of said bottom edge, and approximately one half of said length of said foot extends rearwardly of said bottom edge.

8. A bow sight in accordance with claim 5 characterized in that said means for constraining is adapted to engage a serving string.

9. A bow sight adapted for use with a bow having a bow string comprising separable strands, for providing targeting accuracy, said bow sight adapted to be mounted to said bow string and comprising:

a base portion adapted to be mounted to said bow string, said base portion including a top portion positioned between and engaged by said separable strands of said bow string:

a tab mounted to a top edge of said top portion, wherein substantially all of said base portion is disposed below said top edge, so that a large, open viewing area is provided above a top edge of said tab and between said separable strands of said bow string when said top portion is mounted between and engaged by said separable strands of said bow string;

said top portion having a width relative to remaining portions of said base portion below said top portion so that the maximum spread of said separable strands along the length of said bow sight occurs along said top portion;

said bow sight is configured so that a user's line of sight toward a target is substantially unrestricted through said large, open viewing area when said bow string is substantially fully cocked or drawn by said user; and said tab comprising front and rear surfaces, and said bow sight further comprising active means mounted to said rear surface of said tab for illuminating said tab.

10. A bow sight in accordance with claim 9 characterized in that said active means comprises a light emitting diode (LED).

11. A bow sight in accordance with claim 9 characterized in that said active means is mounted to said tab so as to project illumination at an angle of approximately 45° relative to a vertical axis when said bow string is in an uncocked or undrawn position.

12. A bow sight in accordance with claim 9 characterized in that said rear surface of said tab comprises an upper wall and a lower wall intersecting so as to form an intersecting angle of approximately 90°, and said active means is mounted substantially flush against said upper wall so as to project illumination at an angle of approximately 90° relative to a vertical axis when said bow string is substantially fully drawn.

13. A bow sight adapted for use with a bow having a bow string comprising separable strands, for providing targeting accuracy, said bow sight adapted to be mounted to said bow string and comprising:

a base portion adapted to be mounted to said bow string, said base portion including a top portion positioned between and engaged by said separable strands of said bow string;

a tab mounted to a top edge of said top portion, wherein substantially all of said base portion is disposed below said top edge, so that a large, open viewing area is provided above a top edge of said tab and between said separable strands of said bow string when said top portion is mounted between and engaged by said separable strands of said bow string;

said top portion having a width relative to remaining portions of said base portion below said top portion so that the maximum spread of said separable strands along the length of said bow sight occurs along said top portion;

said bow sight is configured so that a user's line of sight toward a target is substantially unrestricted through said large, open viewing area when said bow string is substantially fully cocked or drawn by said user; and said top portion being substantially heart-shaped and said base portion further comprising a tapered bottom portion mounted to and positioned below said heart-shaped top portion.

14. A bow sight in accordance with claim 13 characterized in that said heart-shaped top portion comprises substantially identical front and rear surfaces and a pair of opposing sides, with each of said sides having an arcuate channel disposed therein and adapted to engage separable strands of said bow string.

15. A bow sight in accordance with claim 14 characterized in that each of said arcuate channels is of a semi-cylindrical configuration.

16. A bow sight in accordance with claim 13 characterized in that said tapered bottom portion comprises:

front and rear surfaces; and a pair of opposing sides, with each of said front and rear surfaces and sides converging inwardly from top to bottom so as to form a bottom edge of said bow sight.

17. A bow sight in accordance with claim 16 characterized in that said bow sight further comprises a substantially cylindrically-shaped foot mounted to said bottom edge and positioned so that a central horizontal axis of said foot is substantially perpendicular to said front and rear surfaces of said heart-shaped top portion.

18. A bow sight in accordance with claim 16 characterized in that said bow sight further comprises a plurality of fingers located in a lower half of said tapered bottom portion, and extending outwardly from said front and rear surfaces of said bottom portion, so that each of said fingers includes a central horizontal axis substantially parallel with a central horizontal axis of said cylindrically-shaped foot.

19. A bow sight adapted for use with a bow having at least one bow string, for providing targeting accuracy, said bow sight adapted to be mounted to said bow string and comprising:

a heart-shaped top portion having substantially identical front and rear surfaces, and a pair of opposing sides, with each of said sides having an arcuate channel disposed therein, and adapted to engage said bow string;

a tapered bottom portion having front and rear surfaces, and a pair of opposing sides, with said front and rear surfaces and said sides of said tapered bottom portion converging inwardly from top to bottom so as to form a bottom edge of said bow sight; and a tab mounted to a top of said heart-shaped top portion.

20. A bow sight in accordance with claim 19 characterized in that said bow sight further comprises:

a substantially cylindrically-shaped foot connected to said bottom edge and positioned so that a central horizontal axis of said foot is substantially perpendicular to said front and rear surfaces of said heart-shaped top portion; and a plurality of fingers extending outwardly from front and rear surfaces of said tapered bottom portion, said foot and said fingers cooperating to secure said bow sight to said bow string.

21. A bow sight in accordance with claim 19 characterized in that said tab comprises a rear surface, and said rear surface of said tab is substantially rectangular.

22. A bow sight in accordance with claim 19 characterized in that said tab comprises a rear surface, and said rear surface of said tab is substantially circular.

23. A bow sight in accordance with claim 19 characterized in that said tab comprises a rear surface, and said rear surface of said tab is substantially oval-shaped.

24. A bow sight in accordance with claim 19 characterized in that said tab comprises a rear surface, and said rear surface of said tab is substantially U-shaped.

25. A bow sight in accordance with claim 19 characterized in that said tab comprises a rear surface, and said rear surface of said tab is substantially V-shaped.

* * * * *